US005948580A

United States Patent [19]

Nakamura et al.

[11] Patent Number: 5,948,580

[45] Date of Patent: Sep. 7, 1999

[54] ELECTROPHOTOGRAPHIC PHOTOCONDUCTOR AND METHOD OF MANUFACTURING THE SAME

[75] Inventors: Yoichi Nakamura; Kazumi Egota; Masahide Takano; Hideki Kina; Akira Ootani, all of Nagano, Japan

[73] Assignee: Fuji Electric Co., Ltd., Japan

[21] Appl. No.: 09/024,903

[22] Filed: Feb. 17, 1998

[30] Foreign Application Priority Data

Feb. 17, 1997 [JP] Japan ..... A 9-030987

[51] Int. Cl.[6] ..... G03G 5/06; G03G 5/09

[52] U.S. Cl. ..... 430/83; 430/78; 430/134; 430/59

[58] Field of Search ..... 430/78, 83, 127, 430/135, 134

[56] References Cited

U.S. PATENT DOCUMENTS 5,350,655 9/1994 Oshiba et al. ..... 430/83

*Primary Examiner*—Roland Martin
*Attorney, Agent, or Firm*—Rossi & Associates

[57] ABSTRACT

An electrophotographic photoconductor having an electrically conductive substrate and a photosensitive layer formed on the conductive substrate is provided wherein the photosensitive layer comprises a layer that contains titanyl oxyphthalocyanine as a photoconductive material, and alkyl polyol that is diol or higher polyol and has hydroxyl groups for every three carbon atoms in a main chain of the alkyl polyol. The content of the alkyl polyol is controlled such that the amount of the hydroxyl groups of the alkyl polyol is in a range of 0.1 mol to 100 mol per 1 mol of titanyl oxyphthalocyanine. A method of manufacturing this electrophotographic photoconductor is also disclosed.

8 Claims, 1 Drawing Sheet

ELECTROPHOTOGRAPHIC PHOTOCONDUCTOR AND METHOD OF MANUFACTURING THE SAME

FIELD OF THE INVENTION

The present invention relates in general to electrophotographic photoconductors used in electrophotographic apparatus, such as printers, copying machines, and facsimile machines, and to a method of manufacturing the photoconductors. More particularly, this invention is concerned with an electrophotographic photoconductor that uses an improved photoconductive material for forming its photosensitive layer, thereby to assure excellent stability, and a method of manufacturing such an electrophotographic photoconductor.

BACKGROUND OF THE INVENTION

Electrophotographic photoconductors are required to have a function of maintaining a surface charge in the dark, function of generating charges upon receipt of light, and a function of transporting the charges upon receipt of light. The electrophotographic photoconductors may include so-called monolayer-type photoconductors having these functions in a single layer, or so-called function-separated laminated-layer type photoconductor having a first layer that mainly serves to generate charges upon receipt of light, and a second layer that serves to maintain the surface charge in the dark and transports charges upon receipt of light.

The above types of electrophotographic conductors are used to form images by known electrophotographic methods, such as the Carlson method. The image formation by this method may be performed by charging the photoconductor in the dark by a corona discharge, forming a desired electrostatic latent image, such as characters or drawing of an original, on the surface of the charged photoconductor, developing the thus formed electrostatic latent image by means of toner particles, transferring and fixing the toner particles representing the desired image onto a support, such as paper. After the toner transfer, remaining toner particles are removed by cleaning, and any residual electrostatic charges are removed by erase exposures, so that the photoconductor can be used again. Conventionally, a photosensitive material of the above-described electrophotographic photoconductor may be obtained by dispersing in a resin binder an inorganic photoconductive substance, such as selenium, selenium alloy, zinc oxide, or cadmium sulfide, or dispersing in a resin binder an organic photoconductive substance, such as poly-N-vinylcarbazole, 9, 10-anthracenediol polyester, hydrazone, stilbene, butadiene, benzidine, phthalocyanine, or bisazo compound, or subjecting these substances to vacuum deposition or sublimation.

Of the above-indicated organic photoconductive materials, various analyses have been made on titanyl oxyphthalocyanine. In order to enhance the stability of the photoconductive material, in particular, an alkyl diol compound having 3 to 12 carbon atoms with two hydroxy groups bonded to non-adjacent carbon atoms may be added to titanyl oxyphthalocyanine that shows the maximum peak at a Bragg angle ($2\theta \pm 0.2°$) of 27.2° in an X-ray diffraction spectrum, as disclosed in Japanese laid-open Patent Publication No. 5-313389.

As described above, titanyl oxyphthalocyanine containing such an additive as described above has been used as the photosensitive material of the electrophotographic photoconductor, as known in the art, and various studies have been conducted on improvement in the stability. The studies, however, have failed to specify or clarify a substance that is related to the characteristic of the resulting photoconductor. Namely, the relationship between the additive and electrophotographic characteristics, in particular, stability, of the photoconductor has not been made clear, though various examples of titanyl oxyphthalocyanine containing an additive have been proposed.

SUMMARY OF THE INVENTION

It is therefore an object of the present invention to clarify the relationship between an additive and electrophotographic characteristics, to provide an electrophotographic photoconductor having excellent electrophotographic characteristics, in particular, high stability, and also provide a method of manufacturing the photoconductor.

As a result of intensive studies to accomplish the above object, the inventors of the present invention found that the stability is remarkably enhanced when the content of a particular alkyl polyol in a photosensitive layer that contains titanyl oxyphthalocyanine is controlled to be within a particular range.

According to one aspect of the present invention, there is provided an electrophotographic photoconductor comprising an electrically conductive substrate, and a photosensitive layer formed on the electrically conductive substrate, wherein the photosensitive layer comprises a layer that contains titanyl oxyphthalocyanine as a photoconductive material, and alkyl polyol that is diol or higher polyol and has hydroxyl groups for every three carbon atoms, and wherein the content of the alkyl polyol is controlled such that the amount of the hydroxyl groups of the alkyl polyol is in a range of 0.1 mol to 100 mol per 1 mol of titanyl oxyphthalocyanine.

According to another aspect of the invention, there is provided a method of manufacturing an electrophotographic photoconductor, comprising the step of applying a coating liquid for a photosensitive layer to an electrically conductive substrate, wherein the coating liquid contains titanyl oxyphthalocyanine, and alkyl polyol that is diol or higher polyol and has hydroxyl groups for every three carbon atoms, that is, C1-, C4-, C7- in the main chain of the alkyl polyol, and wherein the content of the alkyl polyol is controlled such that the amount of the hydroxyl groups of the alkyl polyol is in a range of 0.1 mol to 100 mol per 1 mol of titanyl oxyphthalocyanine.

BRIEF DESCRIPTION OF THE DRAWINGS

The invention will be described in greater detail with reference to certain preferred embodiments thereof and the accompanying drawings, wherein.

DETAILED DESCRIPTION OF THE PREFERRED EMBODIMENTS

Figure 1B:
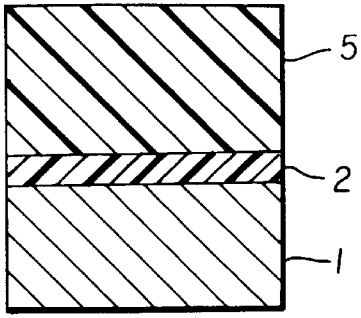
FIG. 1(*a*) is a cross sectional view showing a function-separated type electrophotographic photoconductor, and FIG. 1(*b*) is a cross sectional view showing a monolayer-type electrophotographic photoconductor.

Specific constructions of the electrophotographic photoconductor of the present invention will be described referring to the drawings.

Electrophotographic photoconductors may include negative charge laminated-type photoconductors, positive charge laminated-type photoconductors, and positive charge monolayer-type photoconductors. While the negative charge laminated type photoconductor will be described below in detail by way of example, substances and methods for forming or manufacturing the photoconductor may be suitably selected from known substances and methods, except those related to titanyl oxyphthalocyanine and alkyl polyol.

Figure 1A:
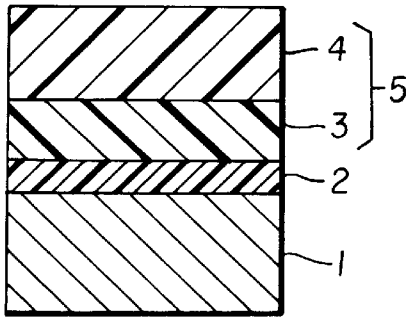

FIGS. 1(*a*) and 1(*b*) are cross sectional views of typical examples of electrophotographic photoconductors, wherein FIG. 1(*a*) shows a function-separated, laminated-type electrophotographic photoconductor, and FIG. 1(*b*) shows a monolayer-type electrophotographic photoconductor. In the negative charge electrophotographic photoconductor of FIG. 1(*a*), an undercoat layer 2 and a photosensitive layer 5 consisting of a charge generation layer 3 having a charge generating function and a charge transport layer 4 having a charge transporting function are successively laminated on an electrically conductive substrate 1. In the positive charge monolayer-type electrophotographic photoconductor of FIG. 1(*b*), an undercoat layer 2 and a single photosensitive layer 5 having both charge generating and charge transporting functions are successively laminated on an electrically conductive substrate 1. Either type of the photoconductors of FIGS. 1(*a*) and 1(*b*) is not necessarily provided with the undercoat layer 2. The photosensitive layer 5 of these photoconductors contains a charge generating agent that generates charges upon receipt of light.

The conductive substrate 1 functions as an electrode of the photoconductor, and also functions as a support for other layers. This substrate 1 may have a cylindrical shape, planar shape, or film-like shape, and may be formed of a metal, such as aluminum, stainless steel or nickel, or glass or resin that has been treated to be given a certain conductivity.

The undercoat layer 2 may be formed of alcohol-soluble polyamide, solvent-soluble aromatic polyamide, or thermosetting urethane resin. The alcohol-soluble polyamide may be preferably selected from copolymeric compounds of nylon 6, nylon 8, nylon 12, nylon 66, nylon 610, nylon 612, and the like, and N-alkyl denatured or N-alkoxyalkyl denatured nylon. Specific examples of these compounds include Amilan CM8000 (available from Toray Industries, Inc, Japan, 6/66/610/12 copolymeric nylon), Elbamide 9061 (available from Du Pont Japan, 6/66/612 copolymeric nylon), Daiamide T-170 (available from Daicel-Huels Co., Ltd., Japan, copolymeric nylon containing nylon 12 as a major component).

To the undercoat layer 2 may be added an inorganic fine powder of $TiO_2$, alumina, calcium carbonate, or silica, for example.

The charge generation layer 3 that generates charges upon receipt of light is formed by directly depositing particles of an organic photoconductive substance on the undercoat layer 2, or coating the layer 2 with a material in which these particles are dispersed in a solvent, using a resin binder. This charge generation layer 3 is desired to exhibit a high charge generating efficiency and also have a high ability of injecting the generated charges into the charge transport layer 4. It is desirable that the charge generation layer 3 be less dependent upon an electric field, and capable of injecting the charges into the charge transport layer 4 even in a low electric field.

According to the present invention, the charge generation layer 3 contains at least titanyl oxyphthalocyanine as a charge generating substance, and alkyl polyol as an additive that is diol or higher polyol and has hydroxyl groups for every three carbon atoms in a main chain of the alkyl polyol. The charge generation layer 3 may further contain other charge generating substance(s) in the form of pigments or dyes, such as various other types of phthalocyanine, azo, quinone, indigo, cyanine, squarilium, and azulenium compounds.

Also, according to the present invention, the content of alky polyol that is diol or higher polyol and has hydroxyl groups for every three carbon atoms in a main chain of the alkyl polyol is controlled so that the hydroxy groups of the alkyl polyol amount to 0.1 mol to 100 mol, more preferably, 20 mol to 40 mol, per 1 mol of titanyl oxyphthalocyanine.

Although how the use of the additive as described above leads to significant improvement in the stability has not been made clear, the following assumption may be presented. Namely, hydrogen bonds appear between nitrogen atoms at the outer periphery of titanyl oxyphthalocyanine molecules and hydrogen atoms of hydroxyl groups of the alkyl polyol, and, if the alkyl polyol has hydroxyl groups for every three carbon atoms in a main chain of the alkyl polyol, the hydroxyl groups may be coordinated at frequency and angle that appropriately match the distance between titanyl oxyphthalocyanine molecules.

If the amount of hydroxyl groups of alkyl polyol per 1 mol of titanyl oxyphthalocyanine is less than 0.1 mol, the above effect of the hydrogen bonds with the hydroxyl groups of alkyl polyol may not be enjoyed by all nitrogen atoms at the periphery of titanyl oxyphthalocyanine, resulting in reduced improvement in the stability. If the amount of the hydroxyl groups exceeds 100 mol, on the other hand, the sensitivity may be deteriorated due to the excessive amount of alkyl polyol.

The titanyl oxyphthalocyanine used in the present invention may be synthesized in the following manner, or in the manner as disclosed in Japanese laid-open Patent Publication No. 3-35245.

Example of synthesis of titanyl oxyphthalocyanine

Initially, 800 g of o-phthalodinitrile (available from Tokyo Kasei Kogyo Co., Ltd., Japan) and 1.8 L of quinoline (available from Kanto Chemical Co., Ltd., Japan) were put into a reaction container and stirred together. Then, 297 g of titanium tetrachloride (available from Kishida Chemical Industries, Co., Ltd., Japan) was dropped and stirred under a nitrogen atmosphere. After dropping, the mixture was heated and stirred at 180° C. for 15 hours.

The liquid obtained as a result of the reaction was cooled down to 130° C., then filtered, and washed with N-methyl-2-pyrrolidinone (available from Kanto Chemical Co., Ltd.). The thus obtained wet cake was heated and stirred at 160° C. for one hour under a nitrogen atmosphere. After cooled and filtered, this wet cake was washed with N-methyl-2-pyrrolidinone, acetone (available from Kanto Chemical Co., Ltd.), methanol (available from Kanto Chemical Co., Ltd.) and warm water, in the order of description.

The wet cake thus obtained is heated and stirred at 80° C. for one hour in a diluted solution of 4 L of water and 360 mL of 36% hydrochloric acid (available from Kanto Chemical Co., Ltd.). The resulting liquid was cooled, filtered, washed with hot water, and then dried.

Subsequently, 200 g of titanyl oxyphthalocyanine as described above was added to 4 kg of 96% sulfuric acid solution of −5° C., while being cooled and stirred so that the liquid temperature did not exceed −5° C. The resulting liquid was then stirred for one hour at a temperature of −5° C. Then, liquid was added into ice water while it was cooled and stirred so that the liquid temperature did not exceed 10° C., and the obtained liquid was cooled and stirred for one hour. This liquid was then filtered and washed with warm water to provide a wet cake.

The wet cake thus obtained was blended with a diluted solution of 10 L of water and 770 mL of 36% hydrochloric acid, and heated and stirred at 80° C. for one hour. The resulting mixture was cooled, filtered, and then washed with warm water to provide a wet cake.

The obtained wet cake and 1.5 L of o-dichlorobenzene (available from Kanto Chemical Co., Ltd.) were put into a ball mill having 6.6 kg of zirconia balls with a diameter of 8 mm, and subjected to milling for 24 hours. The obtained mixture was taken out and filtered with acetone and methanol, washed with water, and then dried, so as to provide titanyl oxyphthalocyanine.

To achieve appropriate sensitivity of the photosensitive layer, it is preferable that the mixture of titanyl oxyphthalocyanine and alkyl polyol as described above shows the maximum peak at a Bragg angle (2θ±0.2°) of 9.6° in its X-ray diffraction spectrum, and more preferably, the diffraction spectrum of this mixture has a plurality of diffraction peaks at at least 9.6°, 14.2°, 14.7°, 18.0°, 24.0°, and 27.2°, and the maximum peak at 9.6°.

It is also preferable that the X-ray diffraction spectrum of the mixture of titanyl oxyphthalocyanine and alkyl polyol as described above has the maximum peak at a Bragg angle (2θ±0.2°) of 27.2°.

The alkyl polyol used in the present invention, which is diol or higher polyol and has hydroxyl groups for every three carbon atoms in a main chain of the alkyl polyol, may be selected from commercially available products, or may be synthesized according to the references (1)–(6) as follows.

(1) T. Lesiak, et al., Chem. Stosow., 16(3), 259 (1972)

(2) D. Segev, European Patent No. 292128

(3) Moriuchi, et al., Japanese laid-open Patent Publication No. 1-61473

(4) M. Kwaitkowski, et al., International Publication No. WO-90/00622

(5) H. J. Weyer, et al., German Patent No. 3903363

(6) C. Sund, et al., Tetrahedron, 52(37), 12275 (1996)

Since the charge transport layer 4 is laminated on the charge generation layer 3, the film thickness of the charge generation layer 3 is determined depending upon the light absorption coefficient of the charge generating substance. Generally, the thickness of the charge generation layer 3 is not greater than 5 μm, and preferably, not greater than 1 μm. The charge generation layer 3 contains a charge generating substance as a major component, to which a charge transport substance and others may be added. As a resin binder for forming the charge generation layer, polymers or copolymers of polycarbonate, polyester, polyamide, polyurethane, epoxy, polyvinyl butyral, phenoxy, silicone, methacrylate, vinyl chloride, ketal, and polyvinyl acetate, and their halides and cyanoethyl compounds, and the like, may be used in appropriate combination. The amount of the charge generating substance is in the range of 10 to 5000 parts by weight, preferably, 50 to 1000 parts by weight, relative to 100 parts by weight of the resin binder.

The charge transport layer 4 is a film formed by coating, using a material in which a selected one or a combination of charge transport substances, such as various types of hydrazone-containing compounds, styril-containing compounds, amine-containing compounds, and their derivatives, is/are dissolved in a resin binder. This charge transport layer 4 serves as an insulating layer in the dark for maintaining the surface charge of the photoconductor, and also has a function of transporting charges injected from the charge generation layer upon receipt of light. The resin binder for forming the charge transport layer 4 may be selected from polymers and copolymers of polycarbonate, polyester, polystyrene and methacrylate, taking account of its mechanical, chemical and electrical stability, adhesive strength and also compatibility with the charge transport substance. The amount of the charge transport substance used in the charge transport layer 4 is in the range of 20 to 500 parts by weight, preferably, 30 to 300 parts by weight, relative to 100 parts by weight of the resin binder. The film thickness of the charge transport layer is preferably controlled to be within the range of 3 to 50 μm, more preferably, 15 to 40 μm, so as to maintain a practically effective surface potential.

The photosensitive layer of the electrophotographic photoconductor of the present invention may be of monolayer type or laminated type, and is not limited to any one of these types.

Dip coating, spray coating or other method may be employed as a method of applying various coating liquids obtained by blending or dispersion as described above.

While various coating methods, such as dip coating or spray coating, may be employed for applying the coating liquid as described above in the manufacturing method of the present invention, this invention is not limited to any one of these methods.

EXAMPLES

Although some examples of the invention will be described below, the present invention is not limited to any one of these examples.

Example 1

70 parts by weight of polyamide resin (Amilan CM 8000 available from Toray Industries, Inc.) was mixed with 930 parts by weight of methanol (available from Wako Pure Chemical Industries, Ltd., Japan), to prepare a coating liquid for an undercoat layer. This coating liquid was applied by dip coating to an aluminum substrate, so as to form an undercoat layer having a thickness of 0.5 μm after it was dried.

10 parts by weight of titanyl oxyphthalocyanine synthesized in the above example of synthesis, 15.65 parts by weight of 1,4-butanediol (available from Wako Pure Chemical Industries, Ltd.) which is equivalent to 20 mol of hydroxyl groups of alkyl polyol per 1 mole of titanyl oxyphthalocyanine, 686 parts by weight of dichloromethane (available from Wako Pure Chemical Industries, Ltd.), and 294 parts by weight of 1,2-dichloroethane (available from Wako Pure Chemical Industries, Ltd.) were mixed together, and dispersed by ultrasonic wave.

Figure 2:
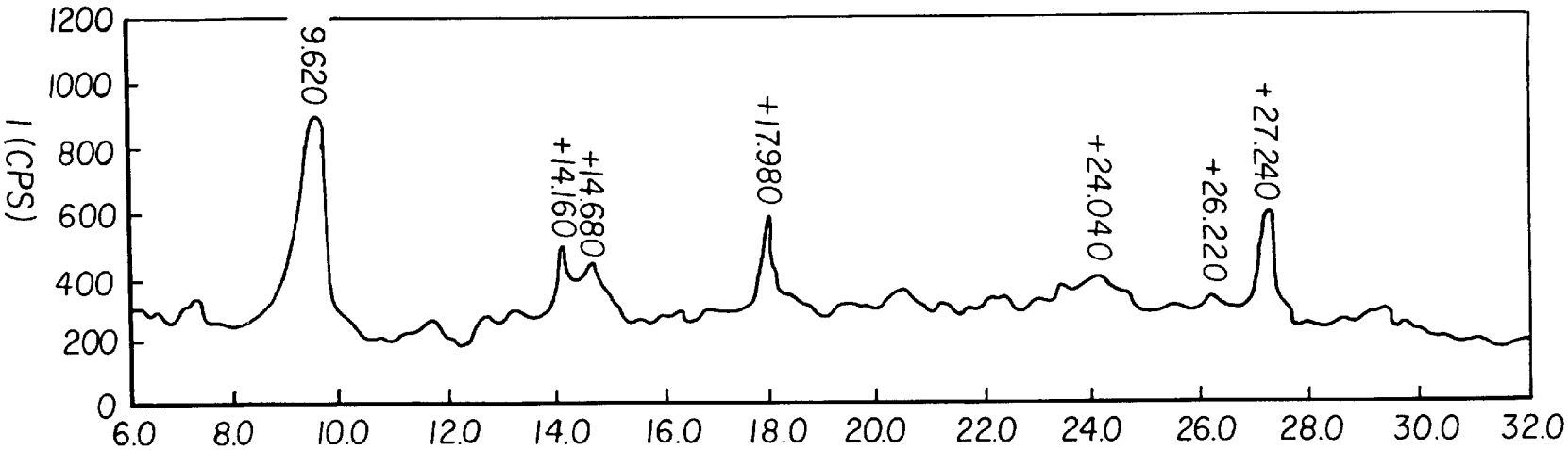
FIG. 2 is a chart showing an example of an X-ray diffraction spectrum measured with respect to one example of the electrophotographic photoconductor according to the present invention.

Subsequently, 10 parts by weight of vinyl chloride resin (MR-110 available from Nippon Zeon Co., Ltd., Japan) was blended into the obtained dispersion liquid, and dispersed by ultrasonic wave so as to produce a coating liquid that provides a charge generation layer. A part of this coating liquid was dried and solidified by evaporation, and an X-ray diffraction spectrum of the crystal was measured using an X-ray diffraction apparatus (MXP18VA available from Mac-Science Inc.). The result of the measurement showed that the X-ray diffraction spectrum had the maximum peak at 9.6°, as shown in the chart of FIG. 2 by way of example. This coating liquid for the charge generation layer was then applied by dip coating onto the undercoat layer as described above, so as to form the charge generation layer having a thickness of 0.2 μm after it was dried. 100 parts by weight of 4-(diphenylamino) benzaldehyde phenyl (2-thienylmethyl) hydrazone (available from Fuji Electric Co., Ltd., Japan), 100 parts by weight of polycarbonate rein (Panlite K-1300 available from Teijin Chemicals, Ltd., Japan), 800 parts by weight of dichloromethane, and 1 part by weight of a silane coupling agent (KP-340 available from Shin-Etsu Chemical Co., Ltd.) were mixed together, to produce a coating liquid for forming a charge transport layer. This coating liquid was applied by dip coating to the charge generation layer as described above, to thus form the charge transport layer having a thickness of 20 μm after it was dried. In this manner, an electrophotographic photoconductor was produced.

Example 2

An electrophotographic photoconductor was produced in the same manner as in Example 1, except that the content of 1,4-butanediol was changed to 31.29 parts by weight (equivalent to 40 mol of hydroxyl groups of alkyl polyol). The X-ray diffraction spectrum measured in the same manner as in Example 1 had a plurality of diffraction peaks having the maximum peak at 9.6°.

Example 3

An electrophotographic photoconductor was produced in the same manner as in Example 1, except that the content of 1,4-butanediol was changed to 0.078 parts by weight (equivalent to 0.1 mol of hydroxyl groups of alkyl polyol). The X-ray diffraction spectrum measured in the same manner as in Example 1 had a plurality of diffraction peaks having the maximum peak at 9.6°.

Example 4

An electrophotographic photoconductor was produced in the same manner as in Example 1, except that the content of 1,4-butanediol was changed to 78.23 parts by weight (equivalent to 100 mol of hydroxyl groups of alkyl polyol). The X-ray diffraction spectrum measured in the same manner as in Example 1 had a plurality of diffraction peaks having the maximum peak at 9.6°.

Example 5

An electrophotographic photoconductor was produced in the same manner as in Example 1, except that titanyl oxyphthalocyanine was synthesized according the method as disclosed in Japanese laid-open Patent Publication No. 3-35245. The X-ray diffraction spectrum measured in the same manner as in Example 1 had the maximum peak at 27.2°.

Example 6

An electrophotographic photoconductor was produced in the same manner as in Example 2, except that titanyl oxyphthalocyanine was synthesized according the method as disclosed in Japanese laid-open Patent Publication No. 3-35245. The X-ray diffraction spectrum measured in the same manner as in Example 2 had the maximum peak at 27.2°.

Example 7

An electrophotographic photoconductor was produced in the same manner as in Example 3, except that titanyl oxyphthalocyanine was synthesized according the method as disclosed in Japanese laid-open Patent Publication No. 3-35245. The X-ray diffraction spectrum measured in the same manner as in Example 3 had the maximum peak at 27.2°.

Example 8

An electrophotographic photoconductor was produced in the same manner as in Example 4, except that titanyl oxyphthalocyanine was synthesized according the method as disclosed in Japanese laid-open Patent Publication No. 3-35245. The X-ray diffraction spectrum measured in the same manner as in Example 4 had the maximum peak at 27.2°.

Example 9

An electrophotographic photoconductor was produced in the same manner as in Example 1, except that 15.65 parts by weight of 1,4-butanediol was replaced by 17.15 parts by weight of 1,4,7-heptanetriol (synthesized at Fuji Electric Co., Ltd., according to an example in a reference) which is equivalent to 20 mol of hydroxyl groups of alkyl polyol. The X-ray diffraction spectrum measured in the same manner as in Example 1 had a plurality of diffraction peaks having the maximum peak at 9.6°.

Example 10

An electrophotographic photoconductor was produced in the same manner as in Example 2, except that 31.29 parts by weight of 1,4-butanediol was replaced by 34.31 parts by weight of 1,4,7-heptanetriol (equivalent to 40 mol of hydroxyl groups). The X-ray diffraction spectrum measured in the same manner as in Example 2 had a plurality of diffraction peaks having the maximum peak at 9.6°.

Example 11

An electrophotographic photoconductor was produced in the same manner as in Example 3, except that 0.078 parts by weight of 1,4-butanediol was replaced by 0.086 parts by weight of 1,4,7-heptanetriol (equivalent to 0.1 mol of hydroxyl groups). The X-ray diffraction spectrum measured in the same manner as in Example 3 had a plurality of diffraction peaks having the maximum peak at 9.6°.

Example 12

An electrophotographic photoconductor was produced in the same manner as in Example 4, except that the 78.23 parts by weight of 1,4-butanediol was replaced by 85.76 parts by weight of 1,4,7-heptanetriol (equivalent to 100 mol of hydroxyl groups). The X-ray diffraction spectrum measured in the same manner as in Example 4 had a plurality of diffraction peaks having the maximum peak at 9.6°.

Example 13

An electrophotographic photoconductor was produced in the same manner as in Example 9, except that titanyl oxyphthalocyanine was synthesized according the method as disclosed in Japanese laid-open Patent Publication No. 3-35245. The X-ray diffraction spectrum measured in the same manner as in Example 9 had the maximum peak at 27.2°.

Example 14

An electrophotographic photoconductor was produced in the same manner as in Example 10, except that titanyl oxyphthalocyanine was synthesized according the method as disclosed in Japanese laid-open Patent Publication No. 3-35245. The X-ray diffraction spectrum measured in the same manner as in Example 10 had the maximum peak at 27.2°.

Example 15

An electrophotographic photoconductor was produced in the same manner as in Example 11, except that titanyl oxyphthalocyanine was synthesized according the method as disclosed in Japanese laid-open Patent Publication No. 3-35245. The X-ray diffraction spectrum measured in the same manner as in Example 11 had the maximum peak at 27.2°.

Example 16

An electrophotographic photoconductor was produced in the same manner as in Example 12, except that titanyl oxyphthalocyanine was synthesized according the method as disclosed in Japanese laid-open Patent Publication No. 3-35245. The X-ray diffraction spectrum measured in the same manner as in Example 12 had the maximum peak at 27.2°.

Example 17

An electrophotographic photoconductor was produced in the same manner as in Example 1, except that the coating liquid for the charge generation layer was put into a closed or sealed container made of glass, and heated for 10 hours in a heating furnace kept at 60° C. The X-ray diffraction spectrum measured in the same manner as in Example 1 had a plurality of diffraction peaks having the maximum peak at 9.6°.

Example 18

An electrophotographic photoconductor was produced in the same manner as in Example 2, except that the coating liquid for the charge generation layer was put into a closed container made of glass, and heated for 10 hours in a heating furnace kept at 60° C. The X-ray diffraction spectrum measured in the same manner as in Example 2 had a plurality of diffraction peaks having the maximum peak at 9.6°.

Example 19

An electrophotographic photoconductor was produced in the same manner as in Example 3, except that the coating liquid for the charge generation layer was put into a closed container made of glass, and heated for 10 hours in a heating furnace kept at 60° C. The X-ray diffraction spectrum measured in the same manner as in Example 3 had a plurality of diffraction peaks having the maximum peak at 9.6°.

Example 20

An electrophotographic photoconductor was produced in the same manner as in Example 4, except that the coating liquid for the charge generation layer was put into a closed container made of glass, and heated for 10 hours in a heating furnace kept at 60° C. The X-ray diffraction spectrum measured in the same manner as in Example 4 had a plurality of diffraction peaks having the maximum peak at 9.6°.

Example 21

An electrophotographic photoconductor was produced in the same manner as in Example 5, except that the coating liquid for the charge generation layer was put into a closed container made of glass, and heated for 10 hours in a heating furnace kept at 60° C. The X-ray diffraction spectrum measured in the same manner as in Example 5 had the maximum peak at 27.2°.

Example 22

An electrophotographic photoconductor was produced in the same manner as in Example 6, except that the coating liquid for the charge generation layer was put into a closed container made of glass, and heated for 10 hours in a heating furnace kept at 60° C. The X-ray diffraction spectrum measured in the same manner as in Example 6 had the maximum peak at 27.2°.

Example 23

An electrophotographic photoconductor was produced in the same manner as in Example 7, except that the coating liquid for the charge generation layer was put into a closed container made of glass, and heated for 10 hours in a heating furnace kept at 60° C. The X-ray diffraction spectrum measured in the same manner as in Example 7 had the maximum peak at 27.2°.

Example 24

An electrophotographic photoconductor was produced in the same manner as in Example 8, except that the coating liquid for the charge generation layer was put into a closed container made of glass, and heated for 10 hours in a heating furnace kept at 60° C. The X-ray diffraction spectrum measured in the same manner as in Example 8 had the maximum peak at 27.2°

Example 25

An electrophotographic photoconductor was produced in the same manner as in Example 9, except that the coating liquid for the charge generation layer was put into a closed container made of glass, and heated for 10 hours in a heating furnace kept at 60° C. The X-ray diffraction spectrum measured in the same manner as in Example 9 had a plurality of diffraction peaks having the maximum peak at 9.6°.

Example 26

An electrophotographic photoconductor was produced in the same manner as in Example 10, except that the coating liquid for the charge generation layer was put into a closed container made of glass, and heated for 10 hours in a heating furnace kept at 60° C. The X-ray diffraction spectrum measured in the same manner as in Example 10 had a plurality of diffraction peaks having the maximum peak at 9.6°.

Example 27

An electrophotographic photoconductor was produced in the same manner as in Example 11, except that the coating liquid for the charge generation layer was put into a closed container made of glass, and heated for 10 hours in a heating furnace kept at 60° C. The X-ray diffraction spectrum measured in the same manner as in Example 11 had a plurality of diffraction peaks having the maximum peak at 9.6°.

Example 28

An electrophotographic photoconductor was produced in the same manner as in Example 12, except that the coating liquid for the charge generation layer was put into a closed container made of glass, and heated for 10 hours in a heating furnace kept at 60° C. The X-ray diffraction spectrum measured in the same manner as in Example 12 had a plurality of diffraction peaks having the maximum peak at 9.6°.

Example 29

An electrophotographic photoconductor was produced in the same manner as in Example 13, except that the coating liquid for the charge generation layer was put into a closed container made of glass, and heated for 10 hours in a heating furnace kept at 60° C. The X-ray diffraction spectrum measured in the same manner as in Example 13 had the maximum peak at 27.2°.

Example 30

An electrophotographic photoconductor was produced in the same manner as in Example 14, except that the coating liquid for the charge generation layer was put into a closed container made of glass, and heated for 10 hours in a heating furnace kept at 60° C. The X-ray diffraction spectrum measured in the same manner as in Example 14 had the maximum peak at 27.2°.

Example 31

An electrophotographic photoconductor was produced in the same manner as in Example 15, except that the coating liquid for the charge generation layer was put into a closed container made of glass, and heated for 10 hours in a heating furnace kept at 60° C. The X-ray diffraction spectrum measured in the same manner as in Example 15 had the maximum peak at 27.2°.

Example 32

An electrophotographic photoconductor was produced in the same manner as in Example 16, except that the coating liquid for the charge generation layer was put into a closed container made of glass, and heated for 10 hours in a heating furnace kept at 60° C. The X-ray diffraction spectrum measured in the same manner as in Example 16 had the maximum peak at 27.2°.

Comparative Example 1

An electrophotographic photoconductor was produced in the same manner as in Example 17, except that the content of 1,4-butanediol was changed to 0.039 parts by weight (that is equivalent to 0.05 mol of hydroxyl groups of alkyl polyol). The X-ray diffraction spectrum measured in the same manner as in Example 17 had a plurality of diffraction peaks including a new peak at 26.2°.

Comparative Example 2

An electrophotographic photoconductor was produced in the same manner as in Example 17, except that the content of 1,4-butanediol was changed to 156.46 parts by weight (that is equivalent to 200 mol of hydroxyl groups of alkyl polyol). The X-ray diffraction spectrum measured in the same manner as in Example 17 had a plurality of diffraction peaks having the maximum peak at 9.6°.

Comparative Example 3

An electrophotographic photoconductor was produced in the same manner as in Comparative Example 1, except that titanyl oxyphthalocyanine was synthesized according the method as disclosed in Japanese laid-open Patent Publication No. 3-35245. The X-ray diffraction spectrum measured in the same manner as in Comparative Example 1 had a plurality of diffraction peaks including a new peak at 26.2°.

Comparative Example 4

An electrophotographic photoconductor was produced in the same manner as in Comparative Example 2, except that titanyl oxyphthalocyanine was synthesized according the method as disclosed in Japanese laid-open Patent Publication No. 3-35245. The X-ray diffraction spectrum measured in the same manner as in Comparative Example 2 had the maximum peak at 27.2°.

Comparative Example 5

An electrophotographic photoconductor was produced in the same manner as in Comparative Example 1, except that 0.039 parts by weight of 1,4-butanediol was replaced by 0.043 parts by weight of 1,4,7-heptanetriol that is equivalent to 0.05 mol of hydroxyl groups of alkyl polyol. The X-ray diffraction spectrum measured in the same manner as in Comparative Example 1 had a plurality of diffraction peaks including a new peak at 26.2°.

Comparative Example 6

An electrophotographic photoconductor was produced in the same manner as in Comparative Example 2, except that 156.46 parts by weight of 1,4-butanediol was replaced by 171.53 parts by weight of 1,4,7-heptanetriol that is equivalent to 200 mol of hydroxyl groups of alkyl polyol. The X-ray diffraction spectrum measured in the same manner as in Comparative Example 2 had a plurality of diffraction peaks having the maximum peak at 9.6°.

Comparative Example 7

An electrophotographic photoconductor was produced in the same manner as in Comparative Example 5, except that titanyl oxyphthalocyanine was synthesized according the method as disclosed in Japanese laid-open Patent Publication No. 3-35245. The X-ray diffraction spectrum measured in the same manner as in Comparative Example 5 had a plurality of diffraction peaks including a new peak at 26.2°.

Comparative Example 8

An electrophotographic photoconductor was produced in the same manner as in Comparative Example 6, except that titanyl oxyphthalocyanine was synthesized according the method as disclosed in Japanese laid-open Patent Publication No. 3-35245. The X-ray diffraction spectrum measured in the same manner as in Comparative Example 6 had the maximum peak at 27.2°.

Comparative Example 9

An electrophotographic photoconductor was produced in the same manner as in Example 18, except that 31.29 parts by weight of 1,4-butanediol was replaced by 21.55 parts by weight of ethylene glycol (equivalent to 40 mol of hydroxyl groups). The X-ray diffraction spectrum measured in the same manner as in Example 18 had a plurality of diffraction peaks having the maximum peak at 26.2°.

Comparative Example 10

An electrophotographic photoconductor was produced in the same manner as in Example 18, except that 31.29 parts by weight of 1,4-butanediol was replaced by 26.43 parts by weight of trimethylene glycol (equivalent to 40 mol of hydroxyl groups). The X-ray diffraction spectrum measured in the same manner as in Example 18 had a plurality of diffraction peaks having a new peak at 26.2°.

Comparative Example 11

An electrophotographic photoconductor was produced in the same manner as in Example 18, except that 31.29 parts by weight of 1,4-butanediol was replaced by 36.16 parts by weight of 1,5-pentanediol (equivalent to 40 mol of hydroxyl groups). The X-ray diffraction spectrum measured in the same manner as in Example 18 had a plurality of diffraction peaks having a new peak at 26.2°.

Comparative Example 12

An electrophotographic photoconductor was produced in the same manner as in Comparative Example 9, except that titanyl oxyphthalocyanine was synthesized according the method as disclosed in Japanese laid-open Patent Publication No. 3-35245. The X-ray diffraction spectrum measured in the same manner as in Comparative Example 9 had the maximum peak at 26.2°.

Comparative Example 13

An electrophotographic photoconductor was produced in the same manner as in Comparative Example 10, except that titanyl oxyphthalocyanine was synthesized according the method as disclosed in Japanese laid-open Patent Publication No. 3-35245. The X-ray diffraction spectrum measured in the same manner as in Comparative Example 10 had a plurality of diffraction peaks including a new peak at 26.2°.

Comparative Example 14

An electrophotographic photoconductor was produced in the same manner as in Comparative Example 11, except that titanyl oxyphthalocyanine was synthesized according the method as disclosed in Japanese laid-open Patent Publication No. 3-35245. The X-ray diffraction spectrum measured in the same manner as in Comparative Example 11 had a plurality of diffraction peaks including a new peak at 26.2°.

The electric characteristics of the thus obtained electrophotographic photoconductors of Examples 1 to 32 and Comparative Examples 1 to 14 were measured using an electrostatic recording paper test apparatus (EPA-8200 available from Kawaguchi Electric Works Co., Ltd., Japan).

The surface of each of the electrophotographic photoconductors was negatively charged in the dark by a corona discharge with corona wires being maintained at −5 kV for 10 seconds. Subsequently, the surface was irradiated with a laser beam having a wavelength of 780 nm, and an exposure amount ($\mu J/cm^2$) was measured when the potential of the charged surface was attenuated from −600 V to −100 V. TABLE 1 below indicates the exposure amount and stability of each of the electrophotographic photoconductors of Examples 1–32 and Comparative Examples 1–14.

TABLE 1-A

| Example No. | Exposure Amount ($\mu J/cm^2$) | Evaluation on Stability |
|---|---|---|
| Example 1 | 0.084 | stable |
| Example 2 | 0.082 | stable |
| Example 3 | 0.087 | stable |
| Example 4 | 0.088 | stable |

TABLE 1-A-continued

| Example No. | Exposure Amount ($\mu J/cm^2$) | Evaluation on Stability |
|---|---|---|
| Example 5 | 0.085 | stable |
| Example 6 | 0.084 | stable |
| Example 7 | 0.087 | stable |
| Example 8 | 0.089 | stable |
| Example 9 | 0.085 | stable |
| Example 10 | 0.082 | stable |
| Example 11 | 0.087 | stable |
| Example 12 | 0.087 | stable |
| Example 13 | 0.085 | stable |
| Example 14 | 0.084 | stable |
| Example 15 | 0.086 | stable |
| Example 16 | 0.088 | stable |
| Example 17 | 0.084 | stable |
| Example 18 | 0.083 | stable |
| Example 19 | 0.087 | stable |
| Example 20 | 0.088 | stable |
| Example 21 | 0.085 | stable |
| Example 22 | 0.085 | stable |
| Example 23 | 0.087 | stable |

TABLE 1-B

| Example No. | Exposure Amount ($\mu J/cm^2$) | Evaluation on Stability |
|---|---|---|
| Example 24 | 0.089 | stable |
| Example 25 | 0.085 | stable |
| Example 26 | 0.082 | stable |
| Example 27 | 0.087 | stable |
| Example 28 | 0.087 | stable |
| Example 29 | 0.085 | stable |
| Example 30 | 0.084 | stable |
| Example 31 | 0.086 | stable |
| Example 32 | 0.087 | stable |
| Comparative Example 1 | 0.121 | unstable |
| Comparative Example 2 | 0.103 | unstable |
| Comparative Example 3 | 0.125 | unstable |
| Comparative Example 4 | 0.112 | unstable |
| Comparative Example 5 | 0.122 | unstable |
| Comparative Example 6 | 0.103 | unstable |
| Comparative Example 7 | 0.125 | unstable |
| Comparative Example 8 | 0.113 | unstable |
| Comparative Example 9 | 0.532 | unstable |
| Comparative Example 10 | 0.102 | unstable |
| Comparative Example 11 | 0.101 | unstable |
| Comparative Example 12 | 0.545 | unstable |
| Comparative Example 13 | 0.110 | unstable |
| Comparative Example 14 | 0.117 | unstable |

As is apparent from TABLE 1, any of Examples 1–32 has a relatively small exposure amount, and has a sufficiently high degree of stability, whereas any of Comparative Examples 1–14 has a relatively large exposure amount, and has a low degree of stability.

In the electrophotographic photoconductor of the present invention having an electrically conductive substrate and a photosensitive layer formed on the electrically conductive substrate, the photosensitive layer contains titanyl oxyphthalocyanine as a photoconductive material, and alkyl polyol that is diol or higher polyol and has hydroxyl groups for every three carbon atoms in a main chain of the alkyl polyol, and the content of the alkyl polyol is controlled such that an amount of the hydroxyl groups of the alkyl polyol is in a range of 0.1 mol to 100 mol per 1 mol of titanyl oxyphthalocyanine. The thus obtained electrophotographic photoconductor exhibits a sufficiently high sensitivity and high stability.

In the method of manufacturing an electrophotographic photoconductor according to the present invention, including a step of applying a coating liquid for a photosensitive layer to an electrically conductive substrate, the coating liquid contains titanyl oxyphthalocyanine, and alkyl polyol that is diol or higher polyol and has hydroxyl groups for every three carbon atoms in a main chain of the alkyl polyol, and the content of the alkyl polyol is controlled such that an amount of the hydroxyl groups of the alkyl polyol is in the range of 0.1 mol to 100 mol per 1 mol of titanyl oxyphthalocyanine. The photoconductor produced according to this method exhibits a sufficiently high sensitivity and high stability.

What is claimed is:

1. An electrophotographic photoconductor comprising an electrically conductive substrate, and a photosensitive layer formed on said electrically conductive substrate, wherein said photosensitive layer comprises a layer that contains titanyl oxyphthalocyanine as a photoconductive material, and alkyl polyol that is diol or higher polyol and has hydroxyl groups for every three carbon atoms in a main chain of the alkyl polyol, and wherein a content of said alkyl polyol is controlled such that an amount of the hydroxyl groups of the alkyl polyol is in a range of 0.1 mol to 100 mol per 1 mol of titanyl oxyphthalocyanine.

2. An electrophotographic photoconductor according to claim 1, wherein a mixture of said titanyl oxyphthalocyanine and said alkyl polyol shows a maximum peak at a Bragg angle (2θ±0.2°) of 9.6° in an X-ray diffraction spectrum thereof.

3. An electrophotographic photoconductor according to claim 1, wherein a mixture of said titanyl oxyphthalocyanine and said alkyl polyol shows a maximum peak at a Bragg angle (2θ±0.2°) of 27.2° in an X-ray diffraction spectrum thereof.

4. An electrophotographic photoconductor according to claim 2, wherein a mixture of said titanyl oxyphthalocyanine and said alkyl polyol shows diffraction peaks at Bragg angles (2θ±0.2°) of at least 9.6°, 14.2°, 14.7°, 18.0°, 24.0° and 27.2° in an X-ray diffraction spectrum thereof.

5. An electrophotographic photoconductor according to claim 1, wherein said alkyl polyol is 1,4-butanediol.

6. An electrophotographic photoconductor according to claim 1, wherein said alkyl polyol is 1,4,7-heptanetriol.

7. A method of manufacturing an electrophotographic photoconductor, comprising the step of applying a coating liquid for a photosensitive layer to an electrically conductive substrate, wherein said coating liquid contains titanyl oxyphthalocyanine, and alkyl polyol that is diol or higher polyol and has hydroxyl groups for every three carbon atoms in a main chain of the alkyl polyol, and wherein a content of said alkyl polyol is controlled such that an amount of the hydroxyl groups of the alkyl polyol is in a range of 0.1 mol to 100 mol per 1 mol of titanyl oxyphthalocyanine.

8. An electrophotographic photoconductor according to claim 1, wherein said alkyl polyol has an hydroxyl on every third carbon atom in the main chain of the alkyl polyol.

* * * * *